US005829133A

United States Patent [19]

Joshi et al.

[11] Patent Number: 5,829,133

[45] Date of Patent: Nov. 3, 1998

[54] METHOD OF MAKING A HEAT EXCHANGER MANIFOLD

[75] Inventors: Shrikant Mukund Joshi, Getzville; Ralph John Honey, Randolph, both of N.Y.

[73] Assignee: General Motors Corporation, Detroit, Mich.

[21] Appl. No.: 751,592

[22] Filed: Nov. 18, 1996

[51] Int. Cl.[6] ..... B23P 15/26

[52] U.S. Cl. ..... 29/890.043; 29/890.052

[58] Field of Search ..... 29/890.052, 890.043; 72/30.1, 48, 352, 354.6, 355.2, 355.4, 370.13, 370.12, 370.1

[56] References Cited

U.S. PATENT DOCUMENTS

| | | | |
|---|---|---|---|
| 2,355,792 | 8/1944 | Franck . | |
| 2,421,629 | 6/1947 | Langos . | |
| 3,446,168 | 5/1969 | Gordon . | |
| 3,643,322 | 2/1972 | Gerstle | 72/367 |
| 3,754,429 | 8/1973 | Creuzet | 72/342 |
| 4,043,015 | 8/1977 | Hickman et al. | 29/890.052 |
| 4,263,799 | 4/1981 | Motizuki | 72/342 |
| 4,287,746 | 9/1981 | Thompson | 72/388 |
| 4,609,138 | 9/1986 | Harrison | 29/890.052 |
| 4,759,405 | 7/1988 | Metzger | 165/173 |
| 4,770,240 | 9/1988 | Dawson et al. | 165/176 |
| 4,825,941 | 5/1989 | Hoshino et al. | 165/110 |
| 4,827,590 | 5/1989 | Metzger | 29/890.052 |
| 5,052,478 | 10/1991 | Nakajima et al. | 165/153 |
| 5,119,552 | 6/1992 | Sutou et al. | 29/890.052 |
| 5,125,454 | 6/1992 | Creamer et al. | 201/890.052 |
| 5,178,209 | 1/1993 | Aoki et al. | 165/110 |
| 5,190,101 | 3/1993 | Jalilevand et al. | 165/176 |
| 5,333,485 | 8/1994 | Ublacker . | |
| 5,337,477 | 8/1994 | Waggoner | 29/890.052 |
| 5,355,941 | 10/1994 | Blankenberger et al. | 165/67 |
| 5,419,174 | 5/1995 | Waggoner | 29/890.052 |
| 5,481,800 | 1/1996 | Hutto et al. | 29/890.052 |
| 5,586,600 | 12/1996 | Cribari | 29/890.052 |

FOREIGN PATENT DOCUMENTS

| | | |
|---|---|---|
| 0254931 | 7/1926 | United Kingdom . |

*Primary Examiner*—Irene Cuda
*Attorney, Agent, or Firm*—Patrick M. Griffin

[57] ABSTRACT

An automotive heat exchanger manifold (56) is formed entirely integrally by starting with a cylindrical blank (10) and integrally forming its ends variously into lower end closures or upper end connectors. Specifically, the lower end of blank (10) is impact extruded into a reduced diameter pin (30) which is not only leak tight and seamless, but inserts into a lower resilient mount (16). The upper end of the blank (10) is cold headed into a line connector (54).

3 Claims, 4 Drawing Sheets

METHOD OF MAKING A HEAT EXCHANGER MANIFOLD

TECHNICAL FIELD

This invention relates to heat exchanger manifolds and specifically to a method for production thereof.

BACKGROUND OF THE INVENTION

Automotive heat exchangers, especially condensers, are increasingly made with a parallel flow, multi tube design in which a plurality of flat flow tubes extend end to end between a pair of parallel tanks or manifolds. Especially when the condenser has one or only a few flow passes, the refrigerant is divided up to flow through many tubes in each pass, but over a short flow path. This may be contrasted with a serpentine type of condenser, in which only one or two tubes wind back and forth from end to end, creating a very long flow path or paths, each with a potentially high pressure drop. The big advantage of the parallel flow design is this low pressure drop, as has been recognized for decades, which allows tubes with a much smaller cross sectional area to be used. The big disadvantage is the necessity of sealing each end of each tube to and through a manifold, since each tube end creates a potential leak point. Newer brazing technology allows the tube ends to be sealed to the manifold consistently enough that the parallel flow design is becoming almost standard.

As condensers have become progressively thinner (as measured in the direction of air flow), and the flow tubes consequently narrower, the manifolds that receive the ends of the tubes can also become smaller in cross section. Ultimately, the manifolds can be made of "one piece" tubular stock, essentially cylindrical, just as the manifolds on older style round flow tube condensers were. With the older and wider flat tubes, it was more space efficient for the manifolds to be made as two piece rectangular tanks, with a U shaped channel and a separate slotted header plate for the tube ends. The term "one piece" is a term of art, however, and the cylindrical, tubular manifolds shown in the prior art, even though they lack the lengthwise seams created by separate header plates, are still really multi piece. This is because the ends of the manifolds must still be sealed, which is generally done by a brazed or welded in plug, at least at one end. The other end of tanks is often sealed by a welded in threaded connector that is later connected to a refrigerant inlet or outlet line.

When the condenser is oriented with the tubes horizontal and the two manifolds located on the sides of the condenser and vertical, as is most common, it is the upper ends of the manifolds that are welded shut with the line connectors, and the lower ends that are simply plugged. An example of this basic design may be seen in U.S. Pat. No. 5,178,209 to Aoki et al. As is typically done with radiators, it may be desired to attach the condenser to the vehicle body structure by fixing the lower ends of the manifolds to the vehicle body. One common mounting practice involves inserting an extension at the lower end of the manifold into a resilient pad. The pad is fixed to a lower rail of the vehicle body, and helps isolate the condenser from vehicle vibrations. An example may be seen in U.S. Pat. No. 5,355,941 issued Oct. 18, 1994 to Blankenberger et al, in which the sealing plug at the end of the manifold tank has a downwardly extending flange that can be attached to a pad with a separate fastener.

In conclusion, manifold designs described regularly as "one piece" are really one piece only along their length, and are closed at each end by separate structures, plugs, fittings and the like, that do entail weld or braze seams. The seams where the end structures are attached create potential leak paths out of the manifolds, which, while they can be adequately sealed, generally involve additional labor beyond the brazing of the tube ends into the manifold. A truly one piece manifold seems yet to have been achieved commercially, but would have clear advantages in terms of part count and labor cost.

SUMMARY OF THE INVENTION

A heat exchanger manifold in accordance with the present invention is characterised by the features specified in claim 1. The invention provides a method for producing a manifold in which at least one end thereof is truly integrally formed, with no braze or weld seam. Preferably, both ends are so formed, creating a one piece manifold that is completely seamless, but for the flow tube end to manifold interfaces.

The manifold of the invention is produced starting with a generally cylindrical, tubular blank that is comparable in diameter to the flow tubes that it will feed. While supporting the inner and outer surfaces of the blank against deformation, one end of the blank is integrally formed closed, with no seam. When the heat exchanger is to be installed with the manifolds vertically oriented, the lower end can be formed into a centrally located, reduced diameter pin adapted to be inserted into a resilient pad fixed to the vehicle body. Next, while still supporting the interior of the blank against deformation, it is punched along its length with sufficient tube slots to accommodate the heat exchanger flow tubes. Preferably, the other, upper end of the manifold is also integrally formed into a line connector that can be joined to one of the heat exchange system lines, thereby eliminating another potential leak point.

BRIEF DESCRIPTION OF THE DRAWINGS

These and other features of the invention will appear from the following written description, and from the drawings, in which.

DESCRIPTION OF THE PREFERRED EMBODIMENT

Figure 1:
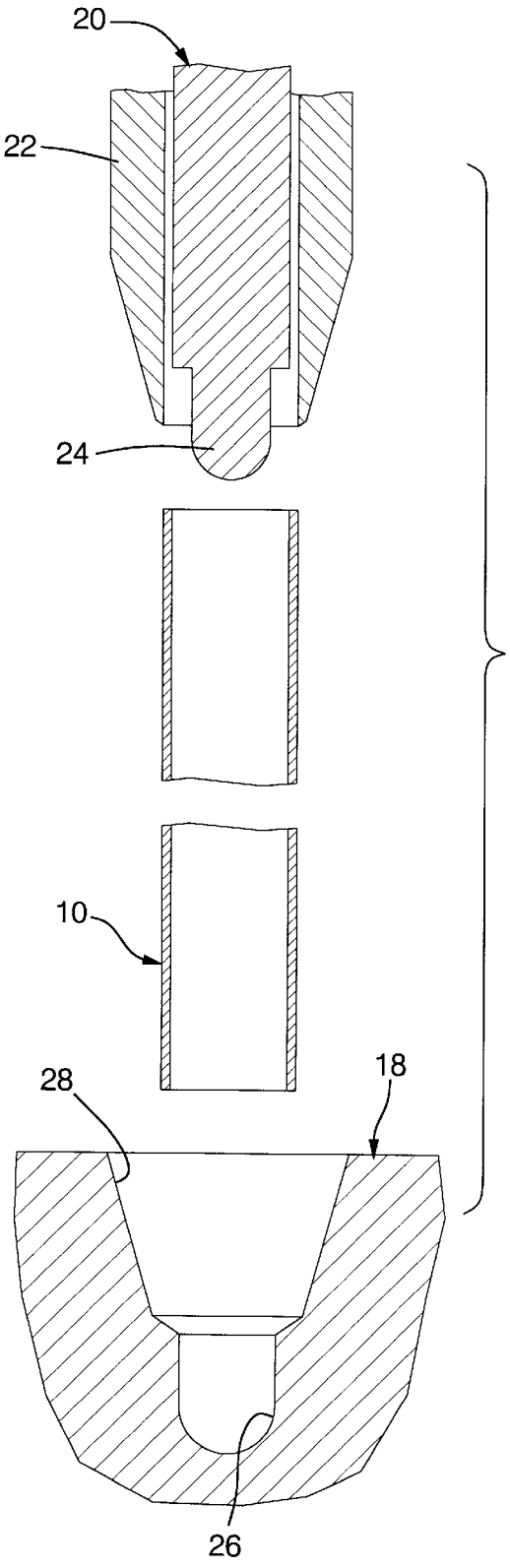
FIG. 1 is a cross sectional view of a tube blank and part of an impact extrusion apparatus used to close the lower end thereof.

Referring first to FIG. 1, the process starts with a simple, generally cylindrical tubular blank 10, which could be a truly seamless extrusion, or even a section of tubing which is formed by folding sheet stock around and into a cylinder and seaming it continuously along the abutting edges. Even in the latter case, the tubing is basically considered "seamless", based on the fact that the pre-existing seam is not one created by the manufacture of the manifold, and is effectively integral and leak proof in any event. Preferably, the material of blank 10 would be an aluminum alloy from the SAE 3000 or 6000 series, a common automotive heat exchanger material. Any plastically deformable metal would work, however.

Figure 7:
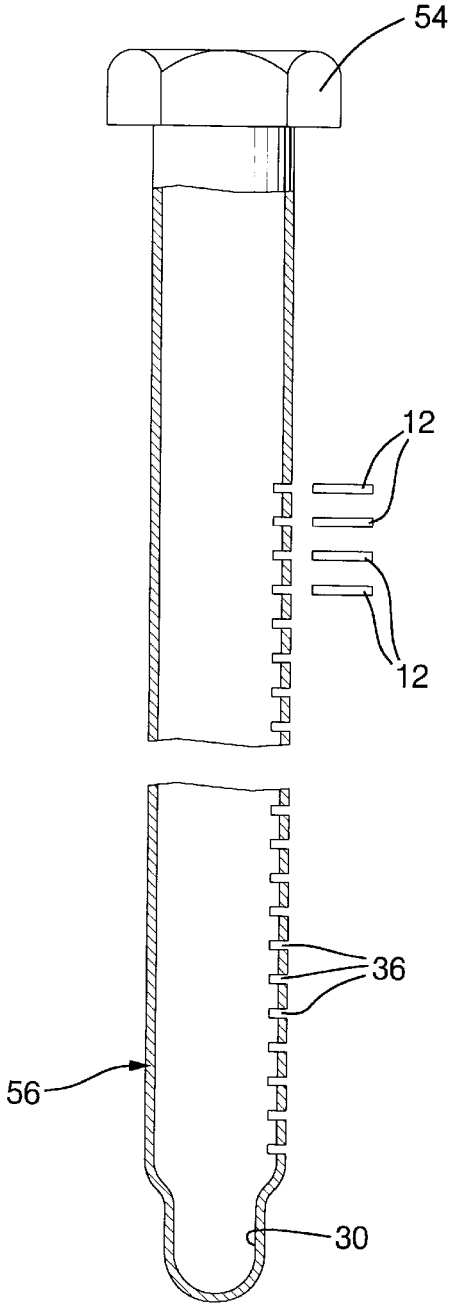
FIG. 7 shows the completed manifold next to the ends of some typical flattened flow tubes.
Figure 8:
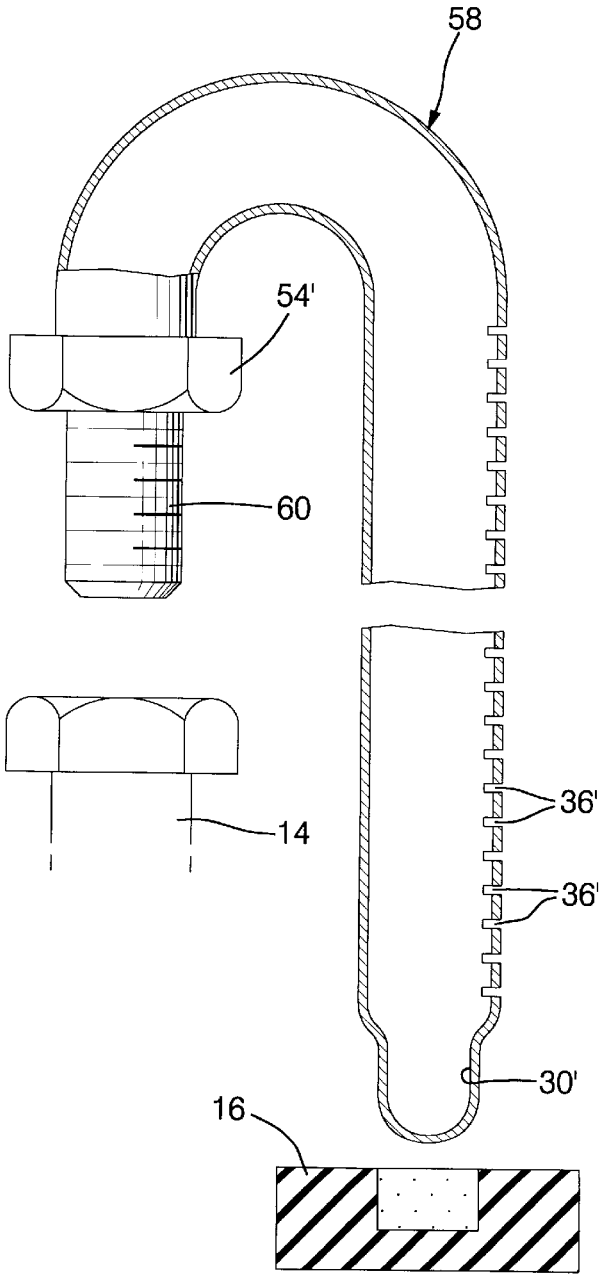
FIG. 8 shows an alternative embodiment of a manifold in which the end of the blank has also been bent around and also showing the addition of a threaded male extension on the line connector.

Referring next to FIGS. 7 and 8, a manifold made according to the invention is intended for use in an automotive heat exchanger, such as a condenser, that has a so called parallel flow configuration. In such a design, an evenly spaced set of parallel flow tubes 12 carries a heat exchange medium, such as refrigerant, in a series of short, parallel paths, from one end to the other. As it flows across the tubes 12, the refrigerant or other medium would be exposed to a cross flow of another heat exchange medium, typically cooler forced air. Generally, thin metal fins, not illustrated, would be bonded between the tubes 12 to assist in thermal exchange. A pair of heat exchange system lines or hoses, one of which is indicated at 14, would supply refrigerant or the like to and from the heat exchanger, and provision must be made to connect them leak tight to the manifolds when the heat exchanger is installed. Also, in the automotive environment, it is common for the manifolds to be oriented vertically, and for the flow tubes to run horizontally. In that case, the lower end of the manifold is usually mounted to the vehicle by fixing it to a resilient pad 16, which, in turn, is securely fixed to a vehicle body structure, such as a lower cross rail. This serves both to support the weight of the heat exchanger, and to isolate it from road induced vibrations.

Referring again to FIG. 1, the blank 10 is formed into a manifold in a series of steps by various apparatuses which, in general, integrally form the material near its ends into other shapes, either to close the end seamlessly, or to form it into another integral structure, or both. This can be contrasted to the typical welding or brazing of separate plug and line connector structures into the tube ends to provide the same functions. In general, these operations would be described as cold or impact extrusion, as applied to the lower end of blank 10, and cold heading, as applied to the upper end. What the operations have in common is the forceful, "impact" forming of the material of the tube end itself, generally without external heating, between two axially opposed tools. Aluminum alloys, being ductile, are particularly amenable to this process. Impact extrusion, in general, involves the plastic flow of a slug or blank forcefully impacted between a stationary die and a moving punch. The workpieces produced are typically hollow or cup shaped, with a wall thickness equal to the radial clearance between the solid punch and the die cavity. Here, the lower end of blank 10 must be closed and sealed somehow, and, in the particular embodiment disclosed, it is also preferred that it be adapted to be easily connected to the resilient pad 16. The basic forming tools consist of a lower die, indicated generally at 18, and an elongated ram, indicated generally at 20. Ram 20 is a cylindrical steel rod, the outer surface of which closely conforms to the inner surface of tubular blank 10, so as to act as an inner supporting mandrel, but with enough radial clearance to be able to pass freely through. In addition, because of the fact that the blank 10 is a long, hollow tube, and not a short, solid slug, an exterior support sleeve 22 is provided to support the outer surface of blank 10, in cooperation with ram 20. The lower end of ram 20 comprises a short, reduced diameter solid punch 24 with a rounded end. Die 18 is a large, heavy steel block into which is machined a concavity 26, the inner surface of which matches the desired outer surface configuration of the part to be formed. The concavity 26 is also congruent to the solid male punch 24, which fits therewithin with a thin and even radial clearance. A long and shallow conical lead in 28 to the concavity 26 is provided, as well, for a purpose described below.

Figure 2:
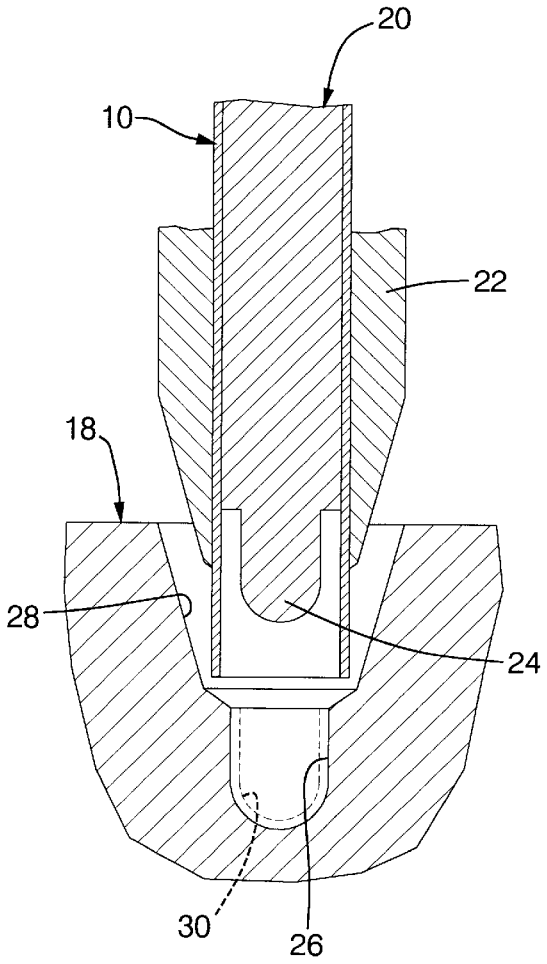
FIG. 2 shows the apparatus of FIG. 1 beginning to close the tube blank lower end.

Referring next to FIG. 2, the basic operation of the ram 20 and die 18 are illustrated. Blank 10 is forced down coaxially toward the die 18, along with the sleeve 22 and ram 20, so as to solidly support all but the lower end of blank 10. The unsupported lower end of blank 10 is funneled inwardly by the lead in 28 and plastically deformed down and into the concavity 26. Concurrently, the punch 24 is forced centrally into the concavity 26, plastically extruding the gathered material into the shape of the radial clearance between the punch 24 and concavity 26, as indicated by the dotted lines. The end result is the formation of a central, reduced diameter, hollow pin 30 at the end of blank 10, which is seamless and leak tight. Only the very end of blank 10 is reshaped, since the ram 20 and sleeve 22 support the rest of blank 10 against wrinkling or buckling.

Figure 3:
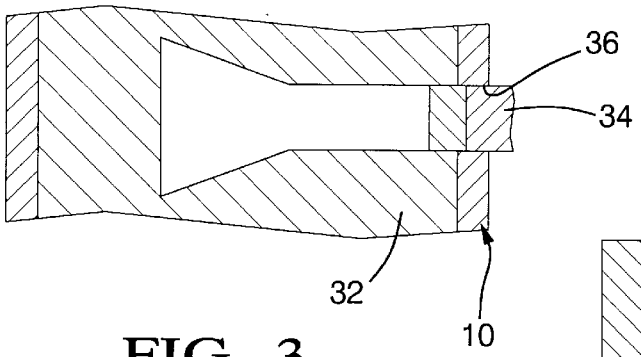
FIG. 3 is a cross section through an apparatus used to pierce the tube slots, showing one slot in the process of being pierced.

Referring next to FIG. 3, the next step in producing a manifold according to the invention is to place the partially formed blank 10 into a standard tube slot piercing apparatus, consisting of a slotted interior support mandrel 32 and slot cutters 34. These produce an evenly spaced series of conventional tube slots 36, one for each flow tube 12. The mandrel 32 assures that the slots 36 are produced in such a way as to support the interior of the blank 10 and leave it substantially cylindrical and unobstructed when the slots 36 are completed.

Figure 4:
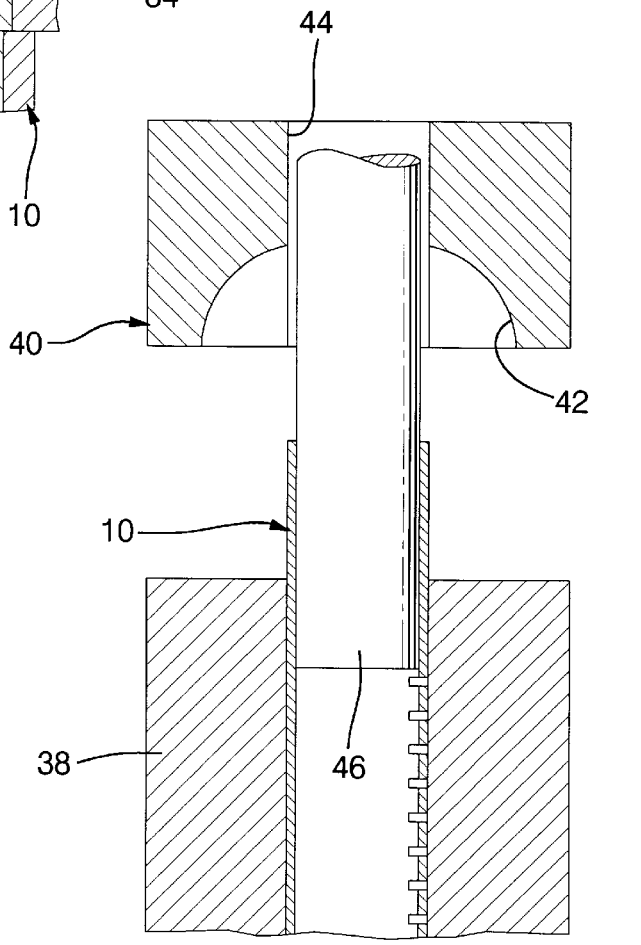
FIG. 4 is a cross sectional view of the tube blank after the forming of the lower end and slots, and showing a cross section of a cold heading apparatus used to form an integral line connector at the upper end of the blank.
Figure 4:
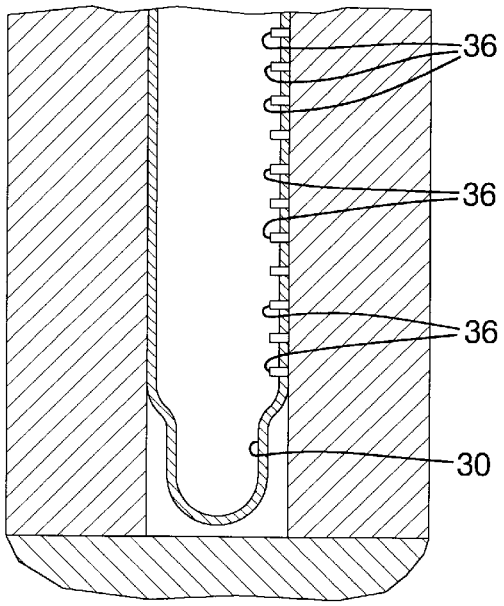

Referring next to FIG. 4, blank 10 is now fully formed, except for the upper end. At this point, depending upon the type of heat exchanger and flow pattern desired, it would be possible to simply close off the upper end of blank 10 as well, in similar fashion to the lower end. This would be done if both the inlet and outlet fittings were to be located on the other manifold. Or, a conventional, separate line connector could be brazed or welded into the upper end of blank 10. However, it will generally be preferred to also integrally form a line connector on the upper end of blank 10, and thereby achieve the ultimate possible reduction in part count and number of potential leak points. The ability to do this, in great part, flows from the fact that the smaller diameter manifolds possible with narrow flow tubes 12 are much closer in diameter to the pre existing system lines, 14 and so do not require great changes in diameter in order to form integral line connectors. In the embodiment disclosed, an integral line connector is formed by first cold heading the upper end of blank 10 between the upper end of an outer support die 38 and a first, hollow punch, indicated generally at 40. Blank 10 sits closely within support die 38, with its upper end extending out. First punch 40 has a generally dome shaped central concavity 42, which opens into a cylindrical passage 44. An interior support mandrel 46 passes closely through passage 44 and down into the interior of blank 10, past the upper end of support die 38. Interior mandrel 46 can fit closely into blank 10 and support it because of the fact that the tube slots 36 were pierced with deforming the wall of the blank inwardly, leaving it cylindrical.

Figure 5:
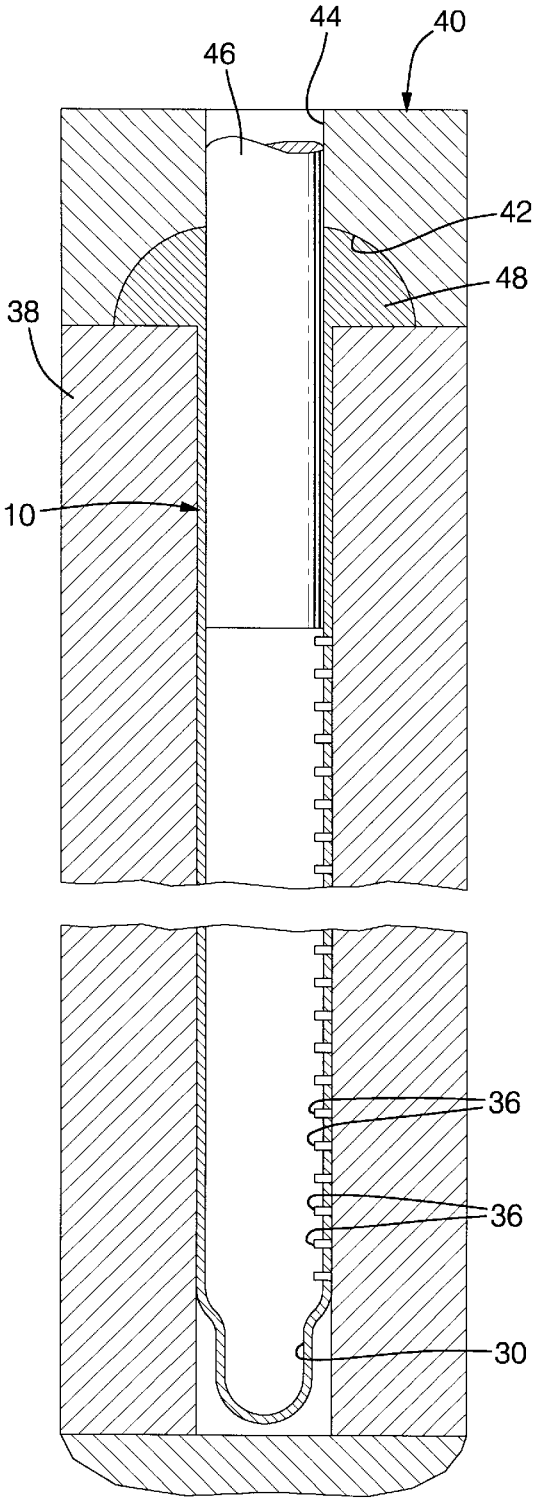
FIG. 5 shows the blank after a first strike in the connector forming process.
Figure 6:
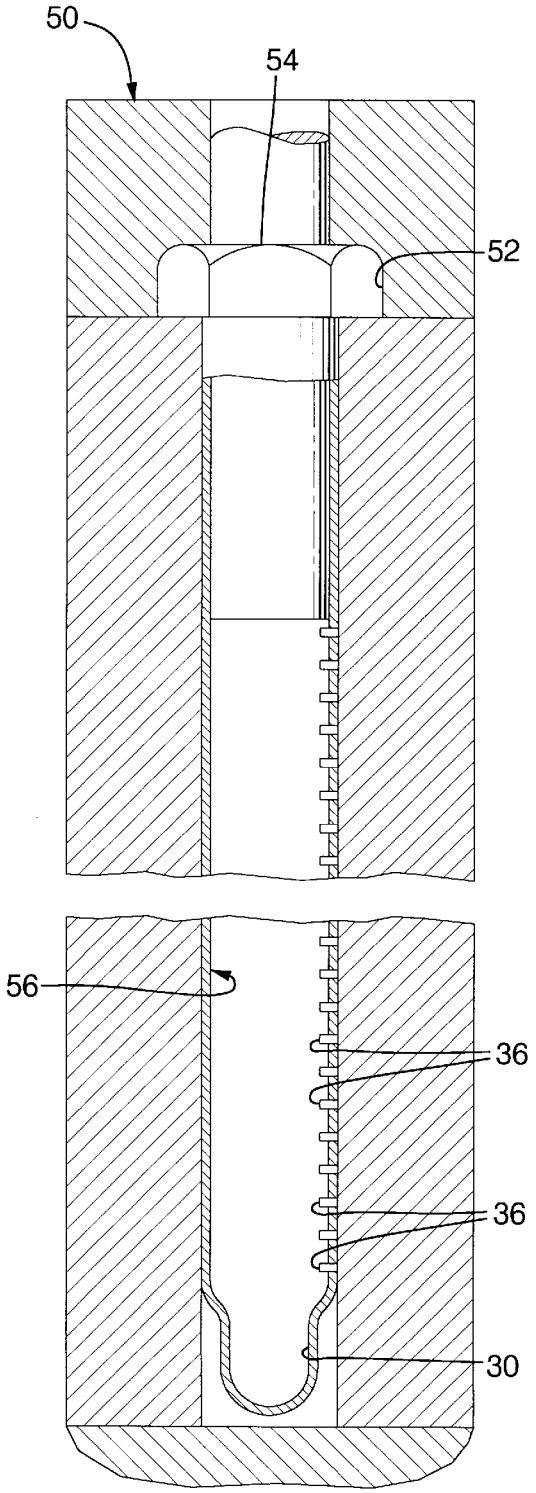
FIG. 6 shows the blank after a second strike in the connector forming process.

Referring next to FIGS. 5, 6 and 7, the first step in cold heading the upper end of the partially completed blank 10 is the forceful impact of first hollow punch 40 against the top of outer support die 38. This serves to gather the unsupported material at the upper end of blank 10 into a generally dome shaped preform 48. Next, as shown in FIG. 6, a second strike is made with against the top of die 38 with a second hollow punch, indicated generally at 50. Second hollow punch 50 is similar to 40, but with a hexagonal concavity 52. This serves to extrude the dome shaped preform 48 into a matching shaped, hollow hexagonal line connector 54. Connector 54 is totally integral to the upper end of the now completed manifold, which indicated generally at 56. The interior of line connector 54 may be threaded by conventional means, as a last step.

Referring next to FIGS. 7 and 8, the hollow, central pin 30 at the bottom of completed manifold 56 and the line connector 54 are both seamless and leak tight, as well as being integrated to the part. The only potential leak paths would be the braze seams between the slots 36 and the flow tubes 12, and the threaded connection between the line connector 54 and the system line, which can't be eliminated. The pin 30 is also the proper size to be inserted into the resilient pad 16, as well as providing an end closure. In an alternative embodiment of a manifold produced according to the invention, indicated generally at 58, most features, such as the central pin and the tube slots, are common, and are given the same number with a prime (').  In addition, however, the unslotted upper portion has been left longer, and bent around 180 degrees. So bending the end, by any desired amount, would allow the line connector 54' to be matched to the pre existing location of the system line 14. Also, the line connector 54' has been formed with a cylindrical upper extension 60, which has been rolled with external threads. This is adapted to accept the type of female connector system line 14 illustrated in FIG. 8. The line connector 54 of manifold 56 would, of course, be used with a male connector on the end of a line The basic methodology of production for each manifold 56 and 58 is the same.

The same basic process of the invention could be used to produce other integral manifolds. For example, the lower end of the blank could be closed off into a simple flat or domed shape, with no central pin, if it were not desired to insert it into a pad. Given its relatively small diameter, the blank 10 could be integrally closed off at either end by a process other than impact extrusion, such as lathe friction spinning. As already noted, the upper ends of either or both manifolds could simply have a separate line connector brazed or welded in place, although more benefit would generally be achieved by fully integrally forming both ends. In some cases, with a two pass condenser, for example, both the inlet and outlet might be on the same manifold. Then, both ends of one manifold would be simply closed off and both ends of the other formed into an integral line connector, with a conventional manifold separator brazed inside the manifold between the two ends. Therefore, it will be understood that it is not intended to limit the invention to just the embodiments disclosed.

We claim:

1. A method of producing a manifold (56) for an automotive vehicle parallel flow heat exchanger of the type having a plurality of flow tubes (12) interconnected by a pair of said manifolds (56), each of which manifolds (56) is fed by a heat exchange system line (14), comprising the steps of;

providing a generally cylindrical tubular blank (10) having a diameter comparable to the width of said flow tubes (12), plastically deforming at least one end of said blank (10) into a seamless closed end (30) while supporting the interior and exterior of said blank (10) against deformation, and, punching a plurality of tube slots (36) along the length of said blank (10) while supporting the interior of said blank (10).

2. The method of claim 1, further characterised in that;

said flow tubes (12) are generally horizontally extending and said manifolds (56) are generally vertical, and at least one end of said manifolds (56) is mounted to a vehicle body mounting structure (16), and said at least one end of said blank (10) is closed by integrally forming it into a central, reduced diameter pin (30) adapted to be inserted into said mounting structure (16).

3. The method of claim 1 or 2, further characterized in that;

the other end of said blank is plastically deformed into a line connector (54) adapted to be connected to one of said heat exchange system lines (14).

* * * * *